US009982412B1

(12) United States Patent
Stolz

(10) Patent No.: US 9,982,412 B1
(45) Date of Patent: May 29, 2018

(54) DRAGLINE BUCKET ASSEMBLY

(71) Applicant: Caterpillar Inc., Peoria, IL (US)

(72) Inventor: Michael Robert Stolz, Franklin, WI (US)

(73) Assignee: Caterpillar Inc., Deerfield, IL (US)

( * ) Notice: Subject to any disclaimer, the term of this patent is extended or adjusted under 35 U.S.C. 154(b) by 0 days. days.

(21) Appl. No.: 15/411,276

(22) Filed: Jan. 20, 2017

(51) Int. Cl.
*E02F 3/48* (2006.01)
*E02F 3/60* (2006.01)
*E02F 9/00* (2006.01)

(52) U.S. Cl.
CPC ..... *E02F 3/60* (2013.01); *E02F 3/48* (2013.01); *E02F 9/006* (2013.01)

(58) Field of Classification Search
CPC ..... E02F 3/48; E02F 3/58
USPC ..... 37/394, 396, 398, 399, 401
See application file for complete search history.

(56) References Cited

U.S. PATENT DOCUMENTS 832,894 A 10/1906 Channon
916,772 A * 3/1909 Page ..... E02F 3/60 37/396
1,201,468 A * 10/1916 Iverson ..... E02F 3/60 37/396
1,228,554 A * 6/1917 Hanot ..... E02F 3/60 37/401
1,268,161 A * 6/1918 Sauerman ..... E02F 3/60 37/396
1,296,800 A * 3/1919 Herring ..... E02F 3/60 37/396
1,442,911 A * 1/1923 Steward ..... B65D 88/56 294/68.26
1,448,212 A 3/1923 Green
2,028,598 A * 1/1936 Gibson ..... F16G 15/00 37/399
2,629,190 A 2/1953 Berner
4,689,904 A * 9/1987 Briscoe ..... E02F 3/60 37/399
5,140,761 A * 8/1992 Coffman ..... E02F 3/58 24/129 A
5,367,798 A * 11/1994 Hughes ..... E02F 3/60 37/397
8,950,091 B2 * 2/2015 Cover ..... E02F 3/48 37/395
2011/0110708 A1 * 5/2011 Miotke ..... E02F 3/58 403/64

* cited by examiner

*Primary Examiner* — Gary S Hartmann
(74) *Attorney, Agent, or Firm* — Eric D. Misfeldt

(57) ABSTRACT

A dragline bucket assembly includes a main body, and a linkage assembly for coupling a hoist chain to the main body. The main body includes a lateral sidewall that has a top edge and a bottom edge. The linkage assembly includes a pivot attachment point provided on the lateral sidewall at a first distance from the top edge. The linkage assembly further includes an elongated link member having a first longitudinal end and a second longitudinal end spaced apart from the first longitudinal end by a length greater than the first distance. The first longitudinal end is pivotally coupled to the lateral sidewall at the pivot attachment point and the second longitudinal end is attached to the hoist chain.

12 Claims, 12 Drawing Sheets

DRAGLINE BUCKET ASSEMBLY

TECHNICAL FIELD

The present disclosure relates generally to a bucket assembly for a dragline excavator and more specifically, relates to a linkage assembly for the bucket assembly.

BACKGROUND

Dragline excavators are utilized in mining operations, such as for removing overburden above a seam or for depositing of a material. The dragline excavators typically use a bucket that is dragged across the ground to perform these operations. Operation of the bucket is controlled by means of hoist and drag machineries, which are controlled by an operator in an operator cabin. Hoist machinery is coupled to the bucket with a hoist chain that is mounted on lateral sidewalls of the bucket. These hoist chains may interfere and hit the sidewalls of the bucket when the bucket moves during operation. It is commonly known to use spreader bar for preventing the hoist chains from hitting the sidewalls of the bucket. However, these spreader bars are susceptible to damage from the bucket body and their maintenance is very expensive. Additionally, these spreader bars add to the weight of the bucket which is not desirable.

U.S. Pat. No. 1,448,212 (hereinafter referred to as '212 patent) relates to a dragline excavator having a supporting cable, a carriage travelling thereon, a stop for the carriage and an excavating bucket swingingly suspended on the carriage. A dumping means is provided on the carriage for dumping the bucket. A draw cable is operatively attached to the bucket and the dumping means. The draw cable is arranged to dump the bucket forcibly by tension on the draw cable when the carriage encounters the stop.

SUMMARY OF THE INVENTION

In one aspect, a dragline bucket assembly is provided. The dragline bucket assembly includes a main body, and a linkage assembly for coupling a hoist chain to the main body. The main body includes a lateral sidewall that has a top edge and a bottom edge. The linkage assembly includes a pivot attachment point provided on the lateral sidewall at a first distance from the top edge. The linkage assembly further includes an elongated link member having a first longitudinal end and a second longitudinal end spaced apart from the first longitudinal end by a length greater than the first distance. The first longitudinal end is pivotally coupled to the lateral sidewall at the pivot attachment point and the second longitudinal end is attached to the hoist chain.

In another aspect, a dragline bucket assembly is provided. The dragline bucket assembly includes a main body, and a linkage assembly for coupling a hoist chain to the main body. The main body includes a lateral sidewall that has a top edge and a bottom edge. The linkage assembly includes a pivot attachment point, a rail and an elongated link member. The pivot attachment point is provided on the lateral sidewall at a first distance from the top edge. The elongated link member having a first longitudinal end and a second longitudinal end spaced apart from the first longitudinal end by a length greater than the first distance. The first longitudinal end is pivotally coupled to the lateral sidewall at the pivot attachment point and the second longitudinal end is attached to the hoist chain. The elongated link member further includes a roller provided between the first longitudinal end and the second longitudinal end. The roller is configured to slidably engage with the rail.

In a yet another aspect, a dragline excavator is provided. The dragline excavator includes a housing that includes a hoist machinery and a drag machinery. A hoist chain is coupled to the hoist machinery and a drag chain is coupled to the drag machinery. The dragline excavator further includes a bucket assembly having a main body, and a linkage assembly for coupling the hoist chain to the main body. The main body includes a lateral sidewall that has a top edge and a bottom edge. The linkage assembly includes a pivot attachment point, a rail and an elongated link member. The pivot attachment point is provided on the lateral sidewall at a first distance from the top edge. The elongated link member having a first longitudinal end and a second longitudinal end spaced apart from the first longitudinal end by a length greater than the first distance. The first longitudinal end is pivotally coupled to the lateral sidewall at the pivot attachment point and the second longitudinal end is attached to the hoist chain. The elongated link member further includes a roller provided between the first longitudinal end and the second longitudinal end. The roller is configured to slidably engage with the rail.

DETAILED DESCRIPTION

Figure 1:
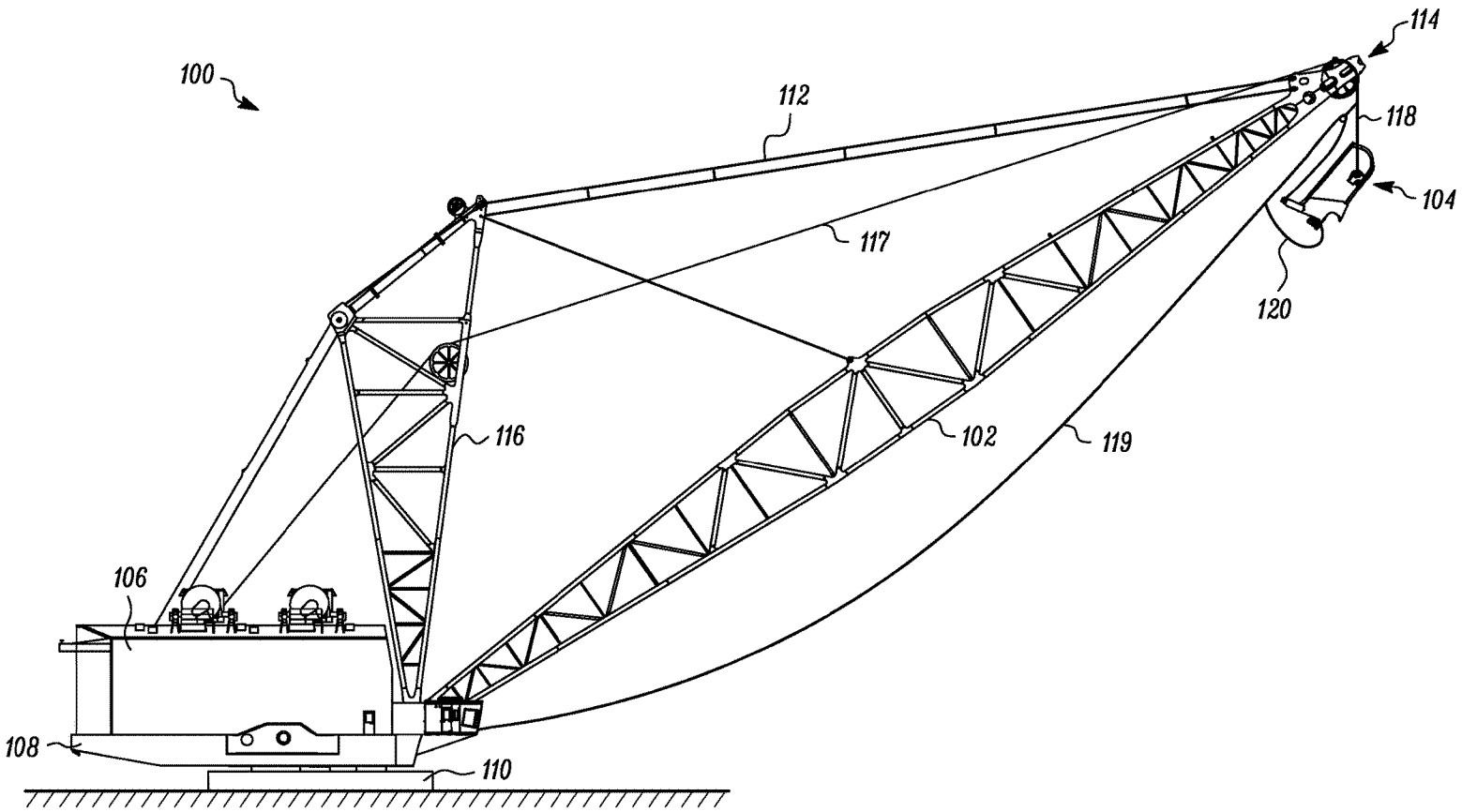
FIG. 1 illustrates an exemplary machine, in accordance with the embodiments of the present disclosure.

Wherever possible, the same reference numbers will be used throughout the drawings to refer to same or the like parts. FIG. 1 illustrates an exemplary machine 100 used for mining operations. The machine 100 may be embodied as a dragline excavator. The machine 100 may include a boom 102, a dragline bucket assembly 104 and a housing 106. The machine 100 further includes a frame 108, rotatably connected to a base 110, to support the housing 106. The boom 102 extends from the housing 106 and is configured to pivot vertically with respect to the housing 106. During operation, the boom 102 may be supported at a desired orientation by a pendant 112 extending from a distal end 114 of the boom 102, to a gantry 116.

The machine 100 operates to remove overburden and/or to deposit material through use of the bucket assembly 104. The bucket assembly 104 may be dragged across a digging path by, taking up and paying out of, one or more hoist ropes 117 (including one or more hoist chains 118) and drag ropes 119 (including one or more drag chains 120) associated with hoist and drag machineries (not shown) of the machine 100, respectively. For example, winding and unwinding of the hoist ropes 117 around a hoist drum (not shown) lifts and lowers the bucket assembly 104 in order to position the bucket assembly 104 at a desired digging location. The drag ropes 119 drag the bucket assembly 104 across the digging path to fill the bucket assembly 104 with the material. The bucket assembly 104 may then be raised and rotated to release the overburden at a desired location. The detailed construction and operation of the hoist and drag machineries are well known in the art and hence not included herein for the sake of brevity of the disclosure.

Figure 2:
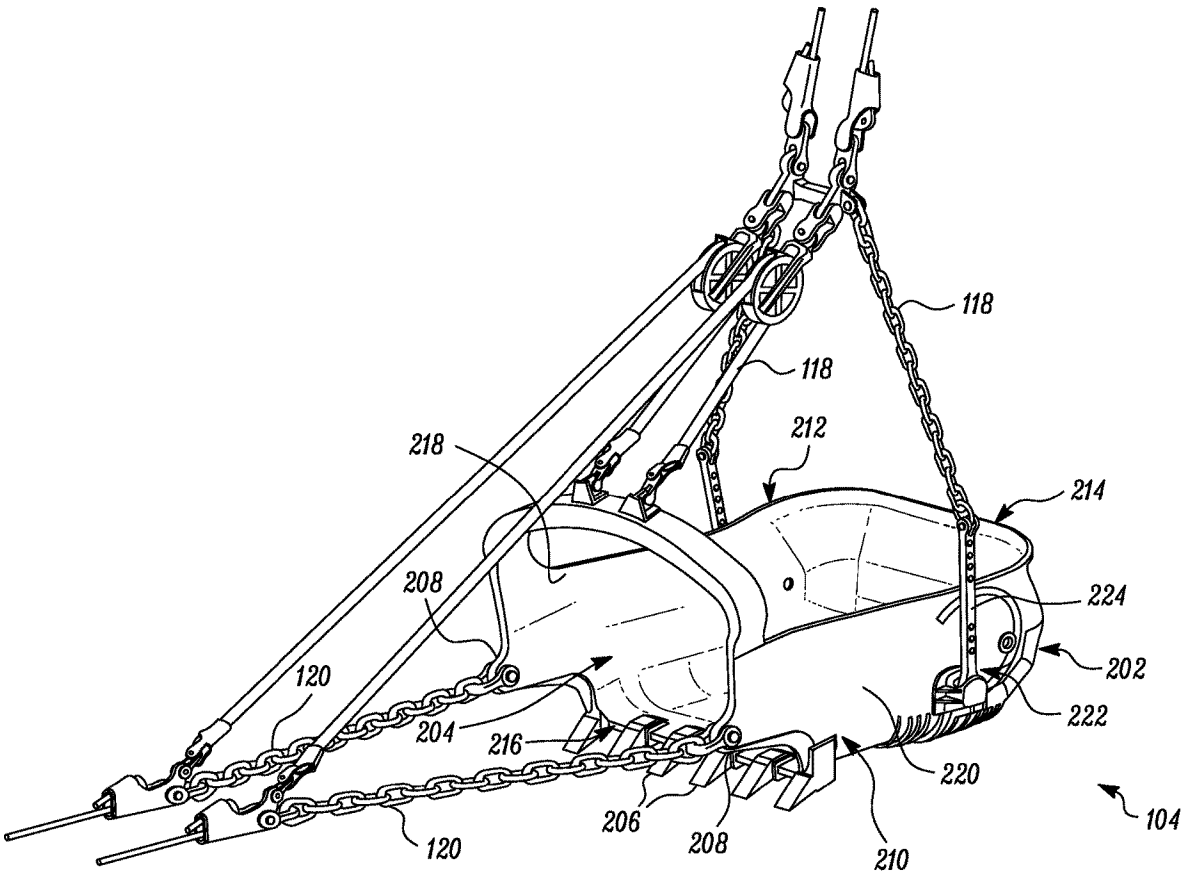
FIG. 2 illustrates an exemplary bucket assembly for the machine, in accordance with the embodiments of the present disclosure.

FIG. 2 illustrates the bucket assembly 104 according to an embodiment of the present disclosure. The bucket assembly 104 includes a main body 202, which may be a box-like structure with an open top and an open front end 204. The open front end 204 of the main body 202 may include a number of replaceable teeth 206 that penetrate into the overburden to fill the bucket assembly 104 with material. The main body 202 further includes one or more forwardly extending mounting lugs 208 to connect drag chains 120 with the bucket assembly 104. The drag chains 120 further connect the bucket assembly 104 to the drag ropes 119.

The main body 202 further includes a first lateral sidewall 210 and a second lateral sidewall 212 (hereinafter collectively referred to as the lateral sidewalls (210, 212)). A rear wall 214 and a bottom wall 216 extend between the first lateral sidewall 210 and the second lateral sidewall 212, as shown, to form the box like structure of the bucket assembly 104. Each of the lateral sidewalls 210, 212 include an inner surface 218 and an outer surface 220 (only one side shown in FIG. 2). According to an embodiment of the present disclosure, the bucket assembly 104 further includes a linkage assembly 222, having an elongated link member 224, to pivotally couple the bucket assembly 104 to hoist chains 118. The linkage assembly 222 is further explained in greater detail with reference to FIG. 3 through FIG. 8.

Figure 3:
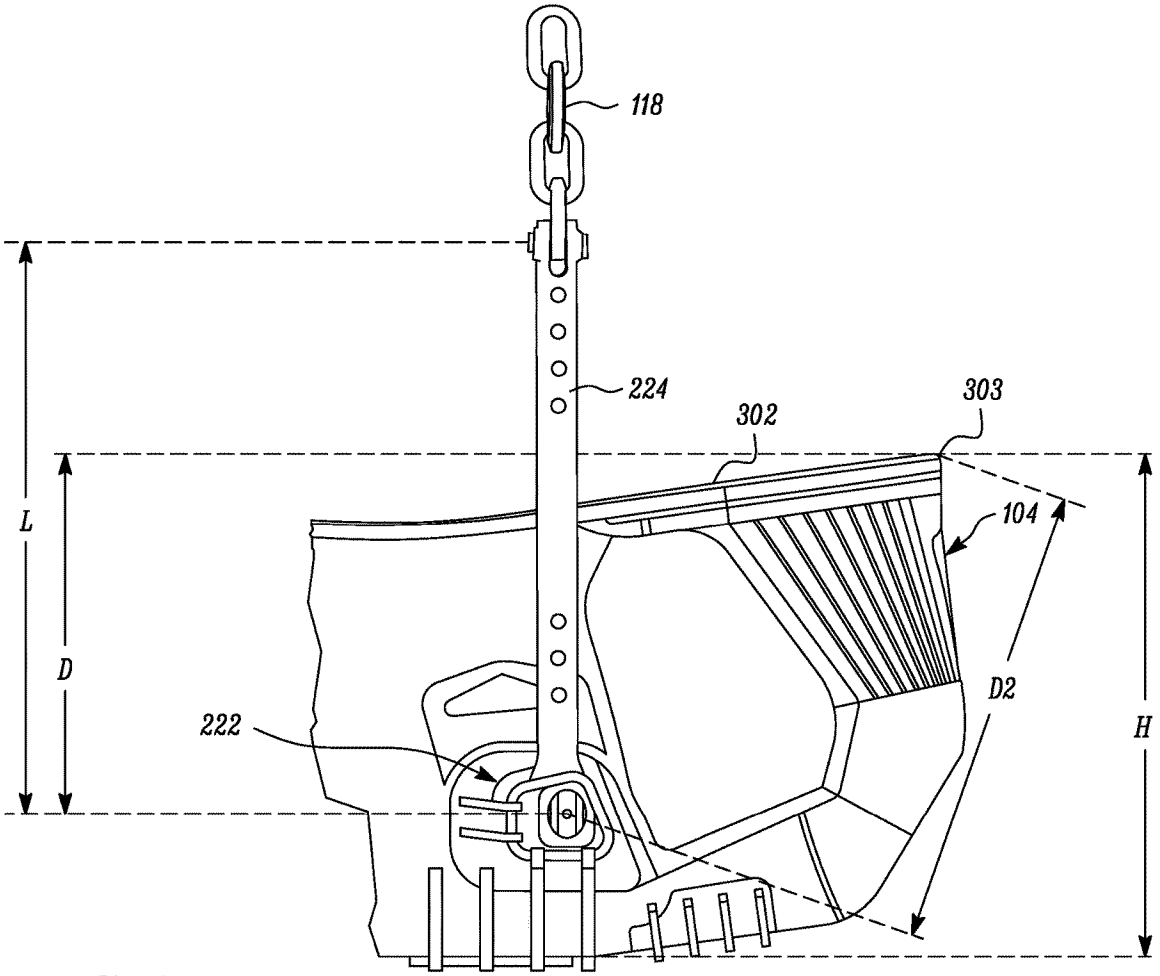
FIG. 3 illustrates a portion of the bucket assembly having a linkage assembly, in accordance with an embodiment of the present disclosure.
Figure 4:
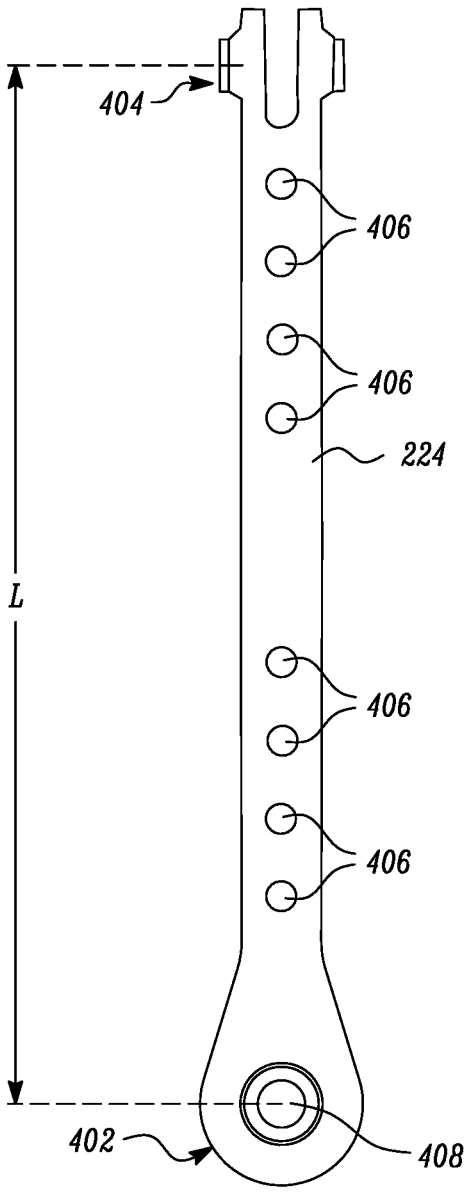
FIG. 4 illustrates an exemplary elongated link member of the linkage assembly, in accordance with an embodiment of the present disclosure.

Referring to FIG. 3 and FIG. 4, a portion of one of the lateral sidewalls (210, 212), of the bucket assembly 104, having the linkage assembly 222 mounted thereon, is shown. As will be understood by a person skilled in the art that the figures show only one lateral sidewall, e.g., the first lateral sidewall 210 having the linkage assembly 222, another linkage assembly 222 may also be provided similarly on the other lateral sidewall, e.g., the second lateral sidewall 212 without deviating from the scope of the claimed subject matter. In an exemplary embodiment, the linkage assembly 222 is provided on the outer surface 220 of the first lateral sidewall 210. However, the linkage assembly 222 may alternatively be provided on the inner surface (not shown) of the first lateral sidewall 210.

As illustrated, the first lateral sidewall 210 includes a top edge 302 and a bottom edge 304 longitudinally spaced apart from each to define a height H of the first lateral sidewall 210. In an embodiment of the present disclosure, the top edge 302 may be inclined to have a rear edge 303 positioned relatively higher with respect to a front edge (not shown) of the top edge 302. Further, the linkage assembly 222 includes a pivot attachment point 306 provided on the first lateral sidewall 210 and the elongated link member 224. For example, the pivot attachment point 306 is provided at a distance D from the top edge 302 of the first lateral sidewall 210. In an embodiment, as shown in the figures, the rear edge 303 may be considered as the top edge 302 and the distance D corresponds to the diagonal distance between the pivot attachment point 306 and the rear edge 303.

The elongated link member 224 includes a first longitudinal end 402 and a second longitudinal end 404 (as shown in FIG. 4) spaced apart to define a length L of the elongated link member 224. The first longitudinal end 402 is configured to be pivotally coupled to the first lateral sidewall 210 at the pivot attachment point 306. The second longitudinal end 404 of the elongated link member 224 is coupled to the hoist chains 118 to facilitate hoisting operations of the bucket assembly 104. For example, the elongated link member 224 includes a coupling aperture 408 provide in proximity to the first longitudinal end 402. The coupling aperture 408 is configured to receive a coupling member (not shown) of the pivot attachment point 306, to facilitate pivotal coupling of the elongated link member 224 to the bucket assembly 104. Such pivot coupling facilitates the tilting of the bucket assembly 104 about the pivot attachment point 306 for digging operation. It may be contemplated that any other pivot mechanism may also be used for pivotally coupling the elongated link member 224 with the bucket assembly 104 at the pivot attachment point 306. Further, the elongated link member 224 further includes a plurality of apertures 406 provided along the length L, in order to reduce the weight of the elongated link member 224.

In an embodiment of the present disclosure, the length L of the elongated link member 224 is greater than the distance D of the pivot attachment point 306 from the top edge 302 of the first lateral sidewall 210. Referring back to FIG. 3, the elongated link member 224 extends beyond the top edge 302 of the first lateral sidewall 210. The length L of the elongated member 224 is selected to be greater than the distance D, so that when the bucket assembly 104 is tilted to the dumping position, the rear edge 303 does not interfere with the elongated link member 224 and the hoist chains 118. In an example, the pivot attachment point 306 may be provided proximal to the bottom edge 304 of the first lateral sidewall 210, such that the distance D between the top edge 302 and the pivot attachment point 306 is substantially close to the height H of the first lateral sidewall 210. In such a case, the length L of the elongated link member 224 may be greater than the height H of the first lateral sidewall 210. Alternatively, the pivot attachment point 306 may be positioned anywhere between the top edge 302 and the bottom edge 304 such that the elongated link member 224 extends beyond the top edge 302 of the first lateral sidewall 210.

Figure 5:
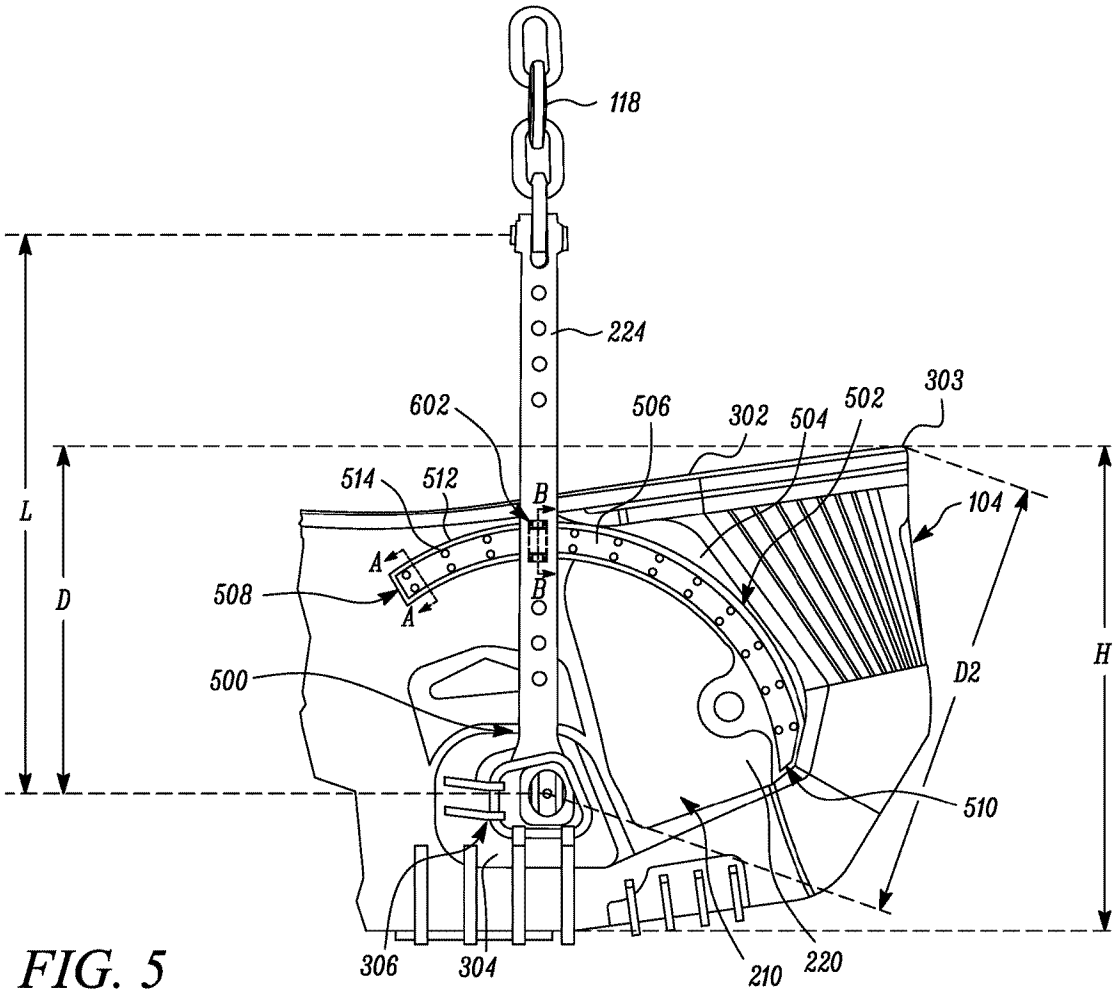
FIG. 5 illustrates a portion of the bucket assembly having a linkage assembly, in accordance with an alternative embodiment of the present disclosure.
Figure 6:
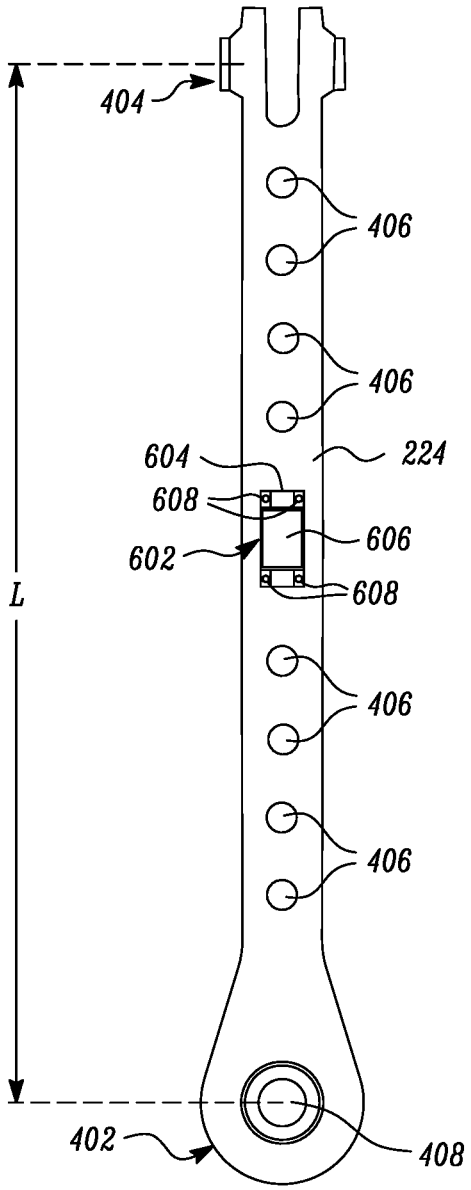
FIG. 6 illustrates an exemplary elongated link member of the linkage assembly, in accordance with the alternative embodiment of the present disclosure.

FIG. 5 illustrates a perspective view of one of the lateral sidewalls (210, 212), of the bucket assembly 104, having a linkage assembly 500 mounted thereon, according to an alternative embodiment of the present disclosure. It may be contemplated that FIG. 5 shows only one lateral sidewall, such as the first lateral sidewall 210, another linkage assembly 500 is also provided on the other lateral sidewall, such as the second lateral sidewall 212.

In an embodiment, the linkage assembly 500 includes the pivot attachment point 306, the elongated link member 224 having a roller assembly 602 (shown in FIG. 6), and a side rail assembly 502. The roller assembly 602 is configured to slidably engage with the side rail assembly 502 in order to facilitate tilting of the bucket assembly 104 about the pivot attachment point 306. As shown in FIG. 5, the side rail assembly 502 may be an arch shaped rail assembly configured to correspond to the tilting path of the bucket assembly 104 about the pivot attachment point 306. However, the shape of the side rail assembly 502 is merely exemplary and may be varied to achieve similar results.

Figure 7:
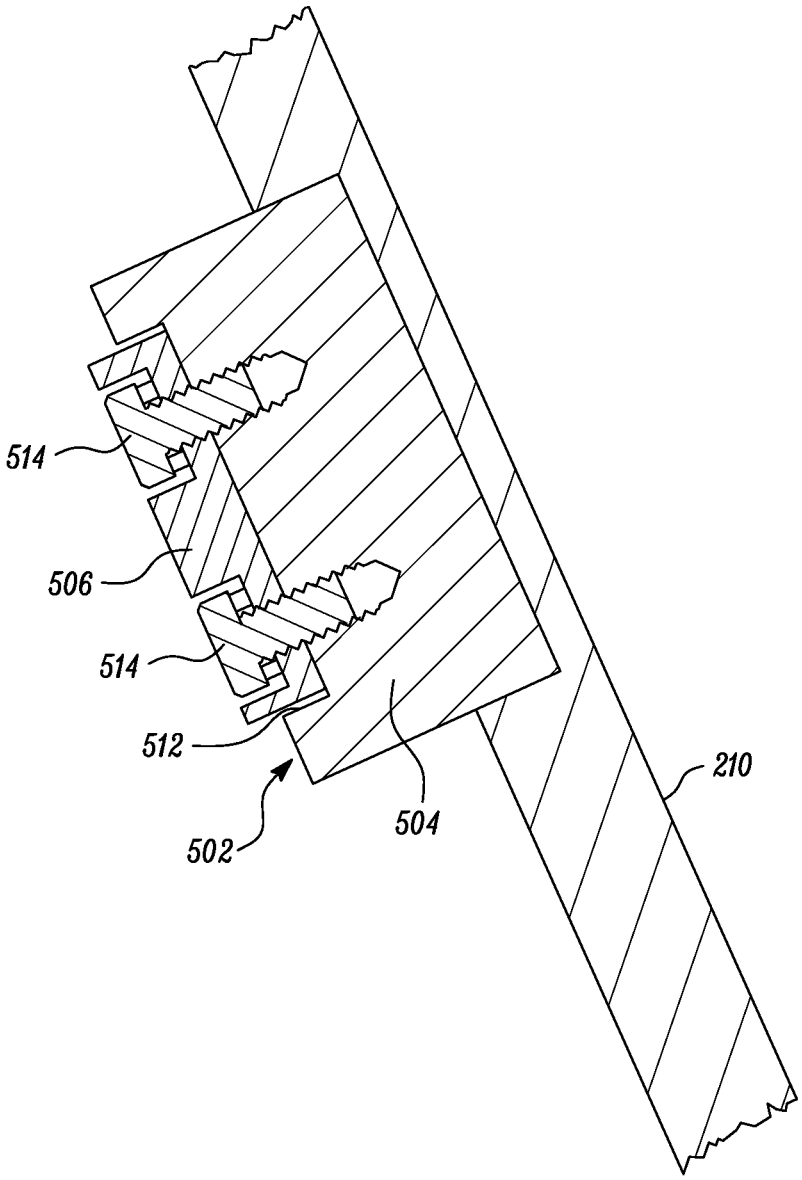
FIG. 7 illustrates a sectional view of a side rail assembly of the linkage assembly, in accordance with the alternative embodiment of the present disclosure.

In an example, the side rail assembly 502 may include a sub rail 504, affixed to the outer surface 220 of the first lateral sidewall 210, and a rail 506 mounted on the sub rail 504. For example, the sub rail 504 may be welded and/or fastened to the first lateral sidewall 210. The added mass of the sub rail 504 provides a strength to the first lateral sidewall 210. The sub rail 504 has a first end 508, a second end 510 and a cavity 512 extending between them. In an exemplary embodiment, the cavity 512 has a rectangular cross-section and is configured to receive the rail 506 therein (as shown in FIG. 7). Although the cross-section of the cavity 512 is shown to be rectangular, it may be contemplated that any other cross-sectional shape may also be visualized without deviating from the scope of the claimed subject matter.

In an embodiment, the rail 506 has a rectangular cross-section, such that at least a portion of the rail 506 is seated inside the cavity 512 of the sub rail 504 (as shown in FIG. 7). The rail 506 also extends between the first end 508 and the second end 510 inside the cavity 512. It may be contemplated that the cross-section of the rail 506 is also exemplary and may be varied corresponding to the cross-section of the cavity 512 of the sub rail 504, so as to facilitate proper seating and affixing of the rail 506 inside the cavity 512. The rail 506 is affixed to the sub rail 504 inside the cavity 512 by one or more fastening elements 514, such as bolts, threaded fasteners, lock washers, etc. Alternatively, the rail 506 may be affixed to the sub rail 504 inside the cavity 512 by any other conventionally known method, such as welding. Although the rail 506 is shown to be affixed to the sub rail 504, it may be contemplated that the sub rail 504 may be omitted in other implementations and the rail 506 may be directly mounted on to the outer surface 220 of the first lateral sidewall 210.

According to an embodiment of the present disclosure, the roller assembly 602 is configured to be disposed in center of the elongated link member 224 between the first longitudinal end 402 and the second longitudinal end 404. However, positioning of the roller assembly 602 is also exemplary and can be varied based on the positioning of the pivot attachment point 306, the side rail assembly 502 and the length L of the elongated link member 224. The roller assembly 602 may include a roller housing 604 configured to encase a shaft or a bush on which a roller 606 rotates. The roller assembly 602 is configured to be mounted in a pocket (not shown) formed in the elongated link member 224. In an embodiment, the roller housing 604 is fastened to the elongated link member 224, by using one or more fasteners 608. It may be well contemplated that any other coupling mechanisms conventionally known in the art may also be used to couple the roller assembly 604 to the elongated link member 224.

Figure 8:
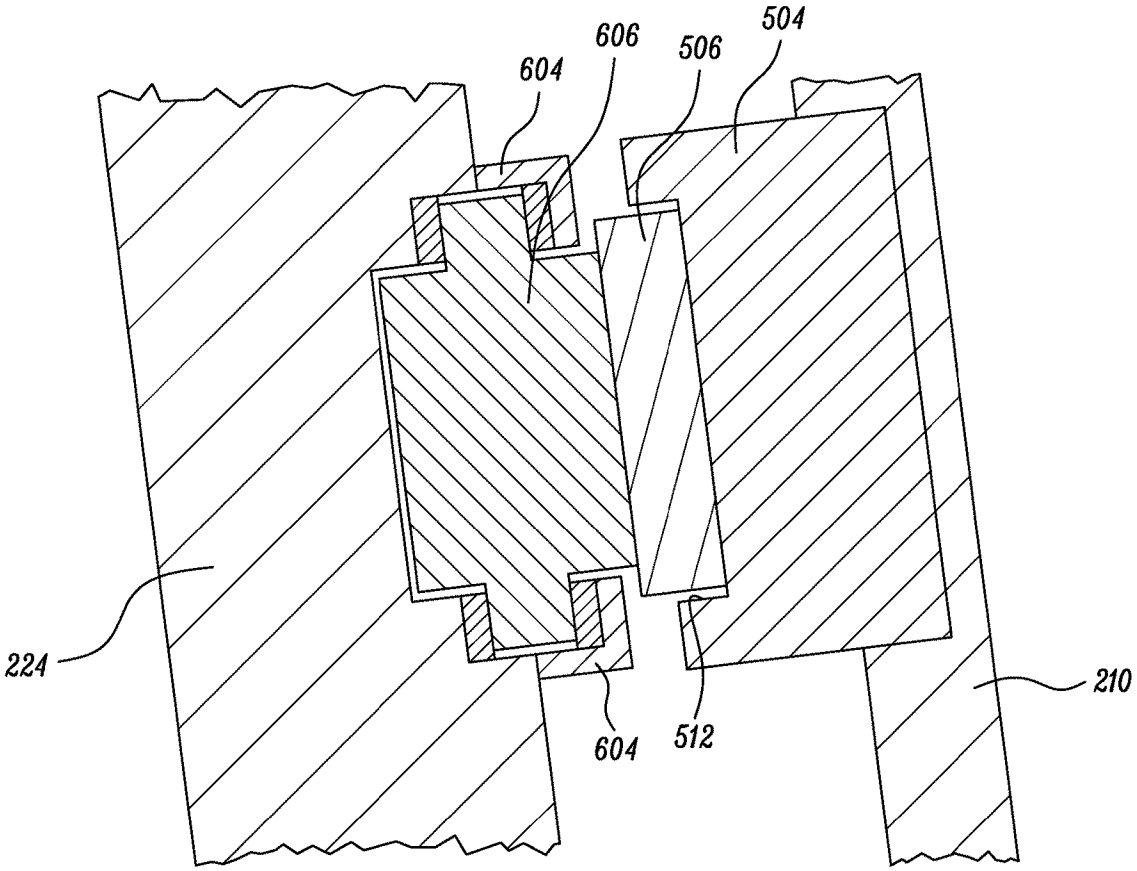
FIG. 8 illustrates a sectional view of a roller assembly and the side rail assembly of the linkage assembly, in accordance with the alternative embodiment of the present disclosure.
Figure 9B:
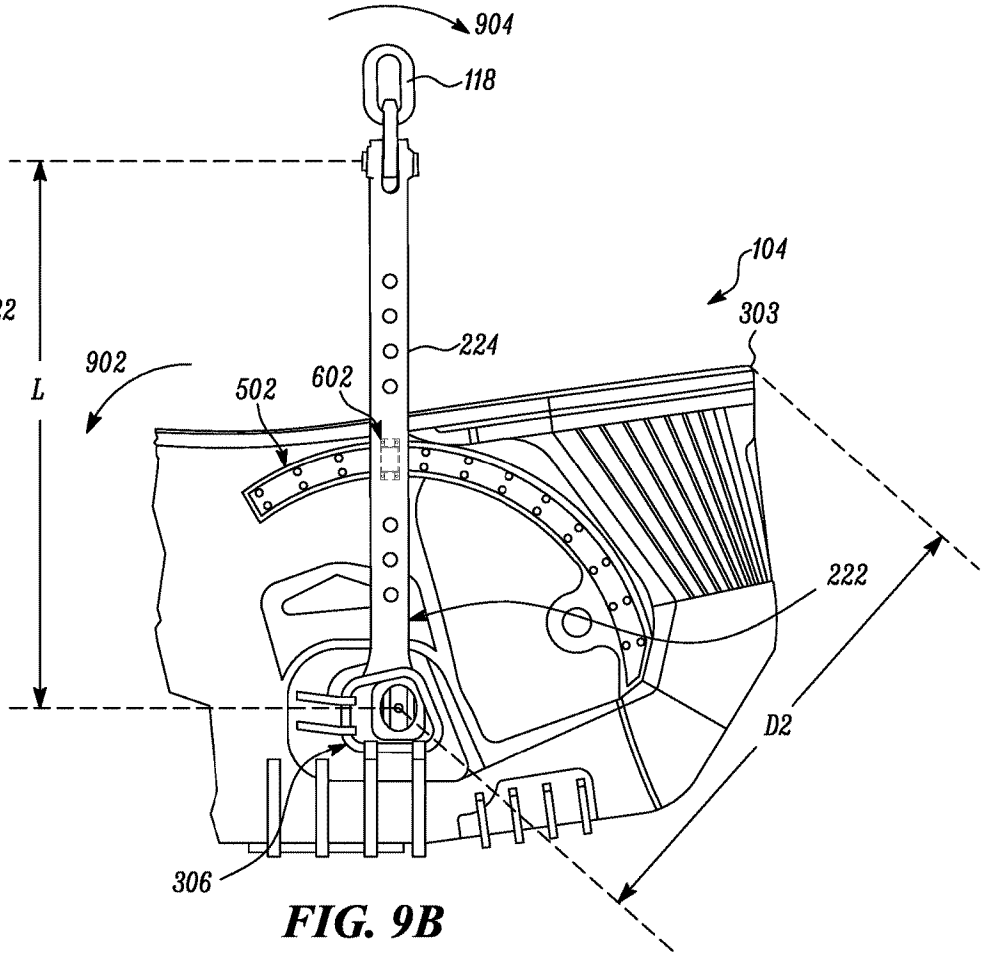
FIG. 9B is a partial side view of FIG. 9A of the bucket assembly and elongated link member in a first exemplary tilt position in accordance with the embodiments of the present disclosure.
Figure 9A:
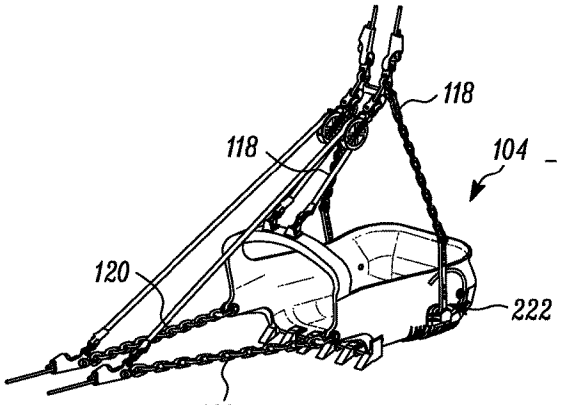
FIG. 9A is a perspective view of the bucket assembly and elongated link member in a first exemplary tilt position in accordance with the embodiments of the present disclosure.
Figures 10A, 10B:
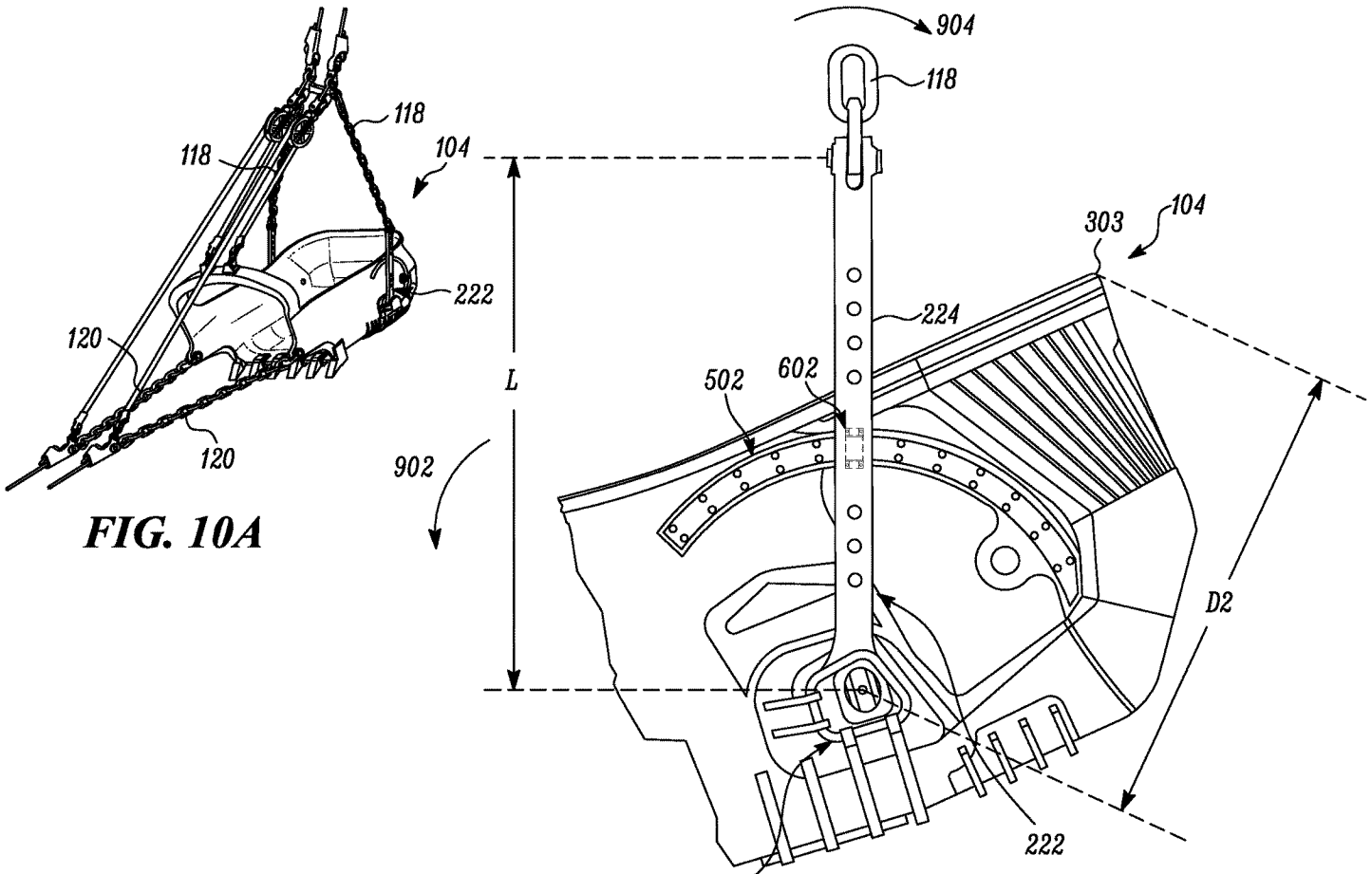
FIG. 10A is a perspective view of the bucket assembly and elongated link member in a second exemplary tilt position in accordance with the embodiments of the present disclosure.
FIG. 10B is a partial side view of FIG. 10A of the bucket assembly and elongated link member in a second exemplary tilt position in accordance with the embodiments of the present disclosure.
Figure 11B:
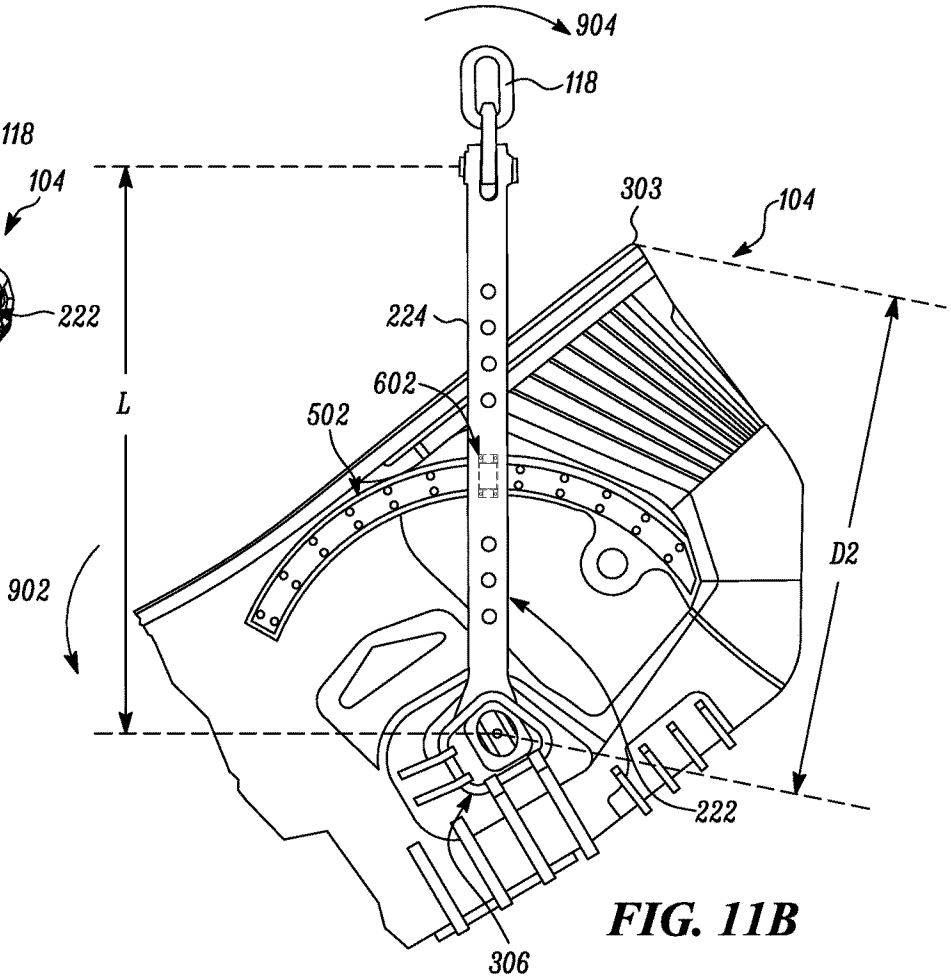
FIG. 11B is a partial side view of FIG. 11A of the bucket assembly and elongated link member in a third exemplary tilt position in accordance with the embodiments of the present disclosure.
Figure 11A:
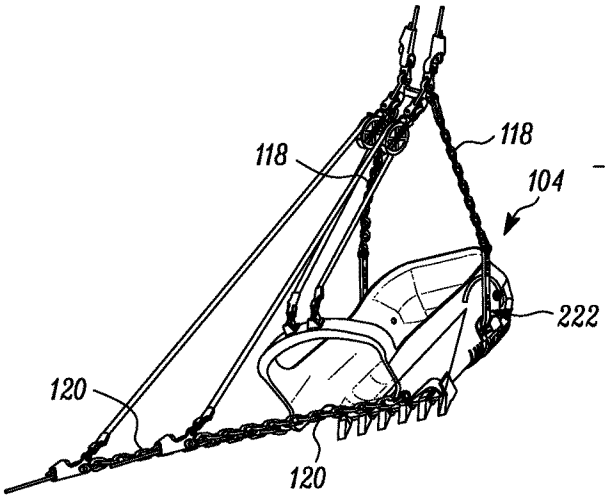
FIG. 11A is a perspective view of the bucket assembly and elongated link member in a third exemplary tilt position in accordance with the embodiments of the present disclosure.
Figure 12B:
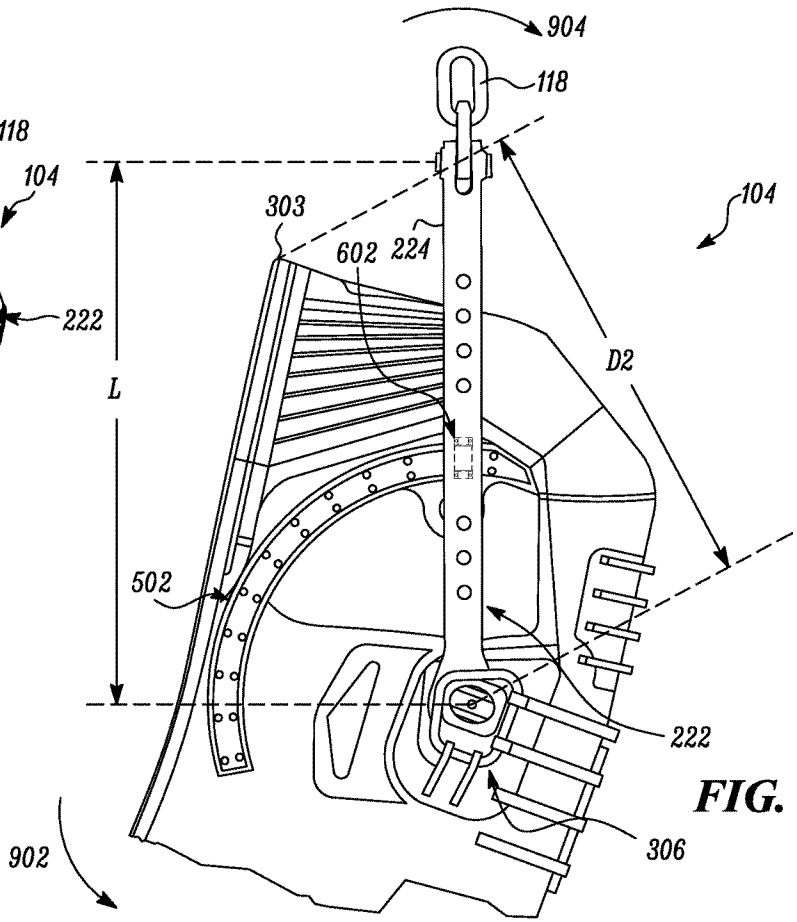
FIG. 12B is a partial side view of FIG. 12A of the bucket assembly and elongated link member in a fourth exemplary tilt position in accordance with the embodiments of the present disclosure.
Figure 12A:
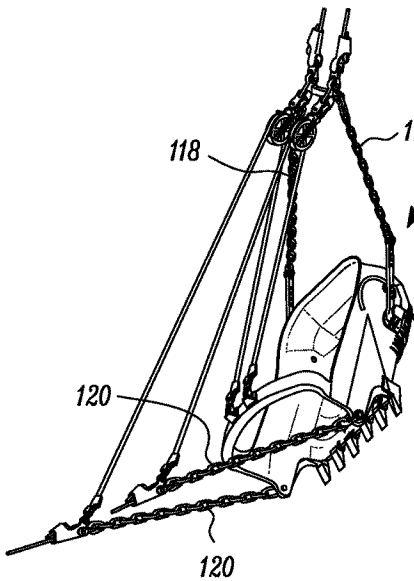
FIG. 12A is a perspective view of the bucket assembly and elongated link member in a fourth exemplary tilt position in accordance with the embodiments of the present disclosure.

The roller 606 of the roller assembly 602 engages with the rail 506 of the side rail assembly 502 (as shown in FIG. 8) in order to facilitate the roller 606 to ride along the rail 506 while tilting of the bucket assembly 104 during operations.

INDUSTRIAL APPLICABILITY

As the machine 100 operates, the bucket assembly 104 is moveable about the pivot attachment point 306 between a digging orientation and a dumping orientation. FIGS. 9A, 10A, 11A, and 12A, as well as FIGS. 9B, 10B, 11B, and 12B sequentially show the tilting movements shown by arrows 902, 904 of the bucket assembly 104 about the pivot attachment point 306, during digging and dumping operations of the machine 100.

Since, the elongated link member 224 extends beyond the top edge 302 of the lateral sidewall 210, 212, it facilitates coupling of the hoist chains 118 to the bucket assembly 104 without letting the hoist chains 118 interfere with the lateral sidewalls 210, 212 of the bucket assembly 104. Further, by use of elongated link members 224 to couple the hoist chains 118 with the bucket assembly 104, usage of conventional spreader bar is eliminated. The bucket assembly 104 according to the various embodiments of the present disclosure is light in weight, thereby facilitating an addition to the material handling capacity volume of the bucket assembly 104.

Furthermore, the roller assembly 602 of the elongated link member 224 and the side rail assembly 502 facilitate smooth movement of the elongated link member 224 on the rail 506 during tilting of the bucket assembly 104. The smooth movement of the elongated link member 224 eliminates the friction, the bending force and the interference with the lateral sidewalls 210, 212.

It should be understood that the above description is intended for illustrative purposes only and is not intended to limit the scope of the present disclosure in any manner. Thus, one skilled in the art will appreciate that other aspects of the disclosure may be obtained from a study of the drawings, the disclosure and the appended claims.

What is claimed is:

1. A dragline bucket assembly comprising:

a main body including a lateral sidewall, the lateral sidewall having a top edge and a bottom edge; and a linkage assembly for coupling a hoist chain to the main body, the linkage assembly including:

a pivot attachment point provided on the lateral sidewall at a first distance from the top edge; and an elongated link member having a first longitudinal end and a second longitudinal end spaced apart from the first longitudinal end by a length greater than the first distance, the first longitudinal end being pivotally coupled to the lateral sidewall at the pivot attachment point and the second longitudinal end being attached to the hoist chain, wherein the linkage assembly further comprising a rail provided on the lateral sidewall, and wherein the linkage assembly further includes a sub rail affixed to the lateral sidewall, the sub rail having a first end, a second end and a cavity extending between the first end and the second end.

2. The dragline bucket assembly as claimed in claim 1, wherein the length of the elongated link member is greater than a height of the lateral sidewall.

3. The dragline bucket assembly as claimed in claim 1, wherein the linkage assembly is provided on an outer surface of the lateral sidewall.

4. The dragline bucket assembly as claimed in claim 1, wherein the rail is affixed inside the cavity of the sub rail.

5. The dragline bucket assembly as claimed in claim 1, wherein the elongated link member includes a roller provided between the first longitudinal end and the second longitudinal end, the roller being configured to slidably engage with the rail provided on the lateral sidewall.

6. A dragline bucket assembly comprising:

a main body including a lateral sidewall, the lateral sidewall having a top edge and a bottom edge; and a linkage assembly for coupling a hoist chain to the main body, the linkage assembly including:

a pivot attachment point provided on the lateral sidewall at a first distance from the top edge;

a rail provided on the lateral sidewall; and an elongated link member including:

a first longitudinal end and a second longitudinal end spaced apart from the first longitudinal end to define a length greater than the first distance, the first longitudinal end being pivotally coupled to the lateral sidewall at the pivot attachment point and the second longitudinal end attached to the hoist chain; and a roller provided between the first longitudinal end and the second longitudinal end, the roller being configured to slidably engage with the rail, wherein the linkage assembly is provided on an outer surface of the lateral sidewall, and wherein the linkage assembly further comprises a sub rail affixed to the lateral sidewall, the sub rail having a first end, a second end and a cavity extending between the first end and the second end.

7. The dragline bucket assembly as claimed in claim 6, wherein the length of the elongated link member is greater than a height of the lateral sidewall.

8. The dragline bucket assembly as claimed in claim 6, wherein the rail is affixed inside the cavity of the sub rail.

9. A dragline excavator comprising:

a housing including a hoist machinery and a drag machinery;

a hoist chain coupled to the hoist machinery;

a drag chain coupled to the drag machinery; and a bucket assembly coupled to the drag chain and the hoist chain, the bucket assembly comprising:

a main body including a lateral sidewall, the lateral sidewall having a top edge and a bottom edge; and a linkage assembly for coupling the hoist chain to the main body, the linkage assembly including:

a pivot attachment point provided on the lateral sidewall at a first distance from the top edge;

a rail provided on the lateral sidewall; and an elongated link member including:

a first longitudinal end and a second longitudinal end spaced apart from the first longitudinal end to define a length greater than the first distance, the first longitudinal end being pivotally coupled to the lateral sidewall at the pivot attachment point and the second longitudinal end attached to the hoist chain; and a roller provided between the first longitudinal end and the second longitudinal end, the roller being configured to slidably engage with the rail, wherein the linkage assembly further comprises a sub rail affixed to the lateral sidewall, the sub rail having a first end, a second end and a cavity extending between the first end and the second end.

10. The dragline excavator as claimed in claim 9, wherein the length of the elongated link member is greater than a height of the lateral sidewall.

11. The dragline excavator as claimed in claim 9, wherein the linkage assembly is provided on an outer surface of the lateral sidewall.

12. The dragline excavator as claimed in claim 9, wherein the rail is affixed inside the cavity of the sub rail.

* * * * *